US012276278B2

(12) United States Patent
Hassan

(10) Patent No.: US 12,276,278 B2
(45) Date of Patent: Apr. 15, 2025

(54) SUBMERSIBLE FUEL OIL SET

(71) Applicant: Hayes Pump, Inc., West Concord, MA (US)

(72) Inventor: Ahmed M. Hassan, Little Falls, NJ (US)

(73) Assignee: HAYES PUMP, INC., West Concord, MA (US)

( * ) Notice: Subject to any disclaimer, the term of this patent is extended or adjusted under 35 U.S.C. 154(b) by 88 days.

(21) Appl. No.: 17/394,530

(22) Filed: Aug. 5, 2021

(65) Prior Publication Data

US 2022/0042508 A1 Feb. 10, 2022

Related U.S. Application Data

(60) Provisional application No. 63/062,881, filed on Aug. 7, 2020.

(51) Int. Cl.
*F04C 13/00* (2006.01)
*F04C 23/02* (2006.01)

(52) U.S. Cl.
CPC ..... *F04C 13/008* (2013.01); *F04C 23/02* (2013.01); *F04C 2210/203* (2013.01)

(58) Field of Classification Search
CPC ..... F04B 23/021; F04B 17/03; F04D 13/086
USPC ..... 417/424.1, 424.2, 423.3, 360, 423.5; 310/87; 248/678, 188.1, 188.8
See application file for complete search history.

(56) References Cited

U.S. PATENT DOCUMENTS 410,811 A * 9/1889 Stevens ..... F16M 5/00 248/678
642,237 A * 1/1900 Lane ..... F04D 29/607 417/399
975,526 A * 11/1910 Hood ..... C11D 3/43 417/376
989,775 A * 4/1911 Fraser ..... F04B 49/24 417/415
1,169,752 A * 1/1916 Loud ..... F04D 29/607 417/479

(Continued)

OTHER PUBLICATIONS https://hayespump.com/products/fuel-oil-pump-sets/, accessed from https://web.archive.org/web/20190607075402/https://hayespump.com/products/fuel-oil-pump-sets/, archived Jun. 7, 2019. (Year: 2019).*

*Primary Examiner* — Charles G Freay
*Assistant Examiner* — Benjamin Doyle
(74) *Attorney, Agent, or Firm* — Lawrence B. Goodwin; Mandelbaum Barrett PC

(57) ABSTRACT

A submersible fuel oil apparatus includes a base; at least one platform supported above the base and having a top surface, an underside surface and an aperture therethrough; a submersible motor mounted on the top surface of the platform and having a motor shaft extending vertically downward through the aperture in the platform; a fuel oil pump supported underneath the platform and having a pump shaft extending vertically upward, a pump inlet into which fuel oil is adapted to be delivered, and a pump outlet from which fuel oil is adapted to be pumped, the pump positioned such that the motor shaft and the pump shaft are aligned; a coupler connecting the motor shaft and pump shaft to each other; inlet piping connected to the pump inlet; and outlet piping connected to the pump outlet.

13 Claims, 3 Drawing Sheets

(56) References Cited

U.S. PATENT DOCUMENTS 1,745,547 A * 2/1930 Layne ..... F04D 29/606 417/423.12
1,767,535 A * 6/1930 William ..... F04D 29/605 248/676
2,056,936 A * 10/1936 Hayward ..... F23D 11/08 417/360
2,181,973 A * 12/1939 Jasberg ..... F04D 13/16 415/196
2,775,905 A * 1/1957 Jackson ..... F16P 1/02 74/609
3,115,096 A * 12/1963 Wall ..... F04D 29/044 417/423.15
3,369,715 A * 2/1968 Carter ..... F04D 29/608 415/199.2
3,391,789 A * 7/1968 Crain ..... C01C 3/20 422/184.1
3,733,151 A * 5/1973 Timmons ..... F04D 29/043 415/213.1
3,771,915 A * 11/1973 Back ..... F04D 29/607 417/360
3,847,504 A * 11/1974 Martin ..... F04D 29/044 415/214.1
3,880,553 A * 4/1975 Wolford ..... F04D 29/607 417/361
4,104,007 A * 8/1978 Hehl ..... F16F 15/08 417/363
4,138,201 A * 2/1979 Dernedde ..... F04D 29/605 376/277
4,230,144 A * 10/1980 Chalmers ..... G21C 13/024 137/343
4,308,000 A * 12/1981 Oakes ..... E03F 5/22 285/24
4,324,533 A * 4/1982 Schroeder ..... F16P 1/02 464/170
4,403,923 A * 9/1983 Korchin ..... F04D 29/607 417/360
4,515,517 A * 5/1985 Sloan ..... F04D 13/046 417/199.2
4,848,409 A * 7/1989 Jahnke, Jr. ..... F16D 3/843 138/158
4,854,828 A * 8/1989 Haentjens ..... F04D 29/043 D15/7
5,011,372 A * 4/1991 Nigrelli ..... C02F 3/165 416/85
5,017,104 A * 5/1991 Baker ..... F04D 29/044 403/80
5,061,157 A * 10/1991 Arakawa ..... F04D 29/426 417/423.9
5,135,364 A * 8/1992 McEwen ..... B01D 21/0012 417/423.15
5,203,681 A * 4/1993 Cooper ..... F04D 7/065 417/372
5,330,328 A * 7/1994 Cooper ..... F04D 29/445 464/182
5,332,373 A * 7/1994 Schendel ..... F04D 1/12 417/424.1
5,480,290 A * 1/1996 Zelder ..... F04D 29/588 417/366
5,489,188 A * 2/1996 Meyer ..... F04D 29/605 248/676
5,558,505 A * 9/1996 Mordue ..... F04D 7/065 266/239
5,634,770 A * 6/1997 Gilbert ..... F04D 29/22 464/181
5,716,195 A * 2/1998 Thut ..... F04D 7/065 417/53
5,842,832 A * 12/1998 Thut ..... F04D 29/628 266/235
6,079,958 A * 6/2000 Qandil ..... F04D 13/022 416/204 R
6,398,521 B1 * 6/2002 Yorulmazoglu ..... F04D 29/044 417/423.6
6,497,559 B1 * 12/2002 Grant ..... F04D 7/065 266/239
7,028,970 B1 * 4/2006 Wiseman ..... F16M 5/00 108/51.11
8,083,501 B2 * 12/2011 Scarsdale ..... E21B 41/0007 417/423.15
8,226,352 B2 * 7/2012 Gutierrez ..... F04D 29/628 415/225
8,328,540 B2 * 12/2012 Wang ..... F04D 29/628 417/423.3
8,382,457 B2 * 2/2013 Wilson ..... F04B 23/00 417/423.15
9,745,993 B2 * 8/2017 Stone ..... F04D 29/043
9,964,113 B2 * 5/2018 Westberg ..... F04D 13/0653
10,760,576 B2 * 9/2020 Tivarovsky ..... F16M 11/20
2003/0152470 A1 * 8/2003 Hoehn ..... E03F 5/22 417/423.3
2005/0214143 A1 * 9/2005 Stirling ..... F04D 29/607 417/423.15
2011/0189036 A1 * 8/2011 Long ..... F04D 29/606 417/423.1
2014/0158320 A1 * 6/2014 Archer ..... F28D 7/06 165/45
2015/0104328 A1 * 4/2015 Babbitt ..... F04B 17/03 417/279
2019/0063441 A1 * 2/2019 Schlittler ..... F04D 13/14
2019/0368547 A1 * 12/2019 LaBarge, III ..... F16C 35/02

* cited by examiner

SUBMERSIBLE FUEL OIL SET

CROSS-REFERENCE TO RELATED APPLICATION

This application claims the benefit of U.S. Provisional Application Ser. No. 63/062,881 for SUBMERSIBLE FUEL OIL SET, filed on Aug. 7, 2020, the entire disclosure of which is hereby incorporated by reference.

BACKGROUND OF THE INVENTION

Residential and commercial buildings typically are provided with fuel oil pumps for pumping fuel oil to necessary machinery, such as boilers or generators. There exists an important need for fuel oil pumps that can operate in flooded conditions, as can be experienced during severe storms, such as hurricanes and the like, particularly in low-lying areas that are prone to flooding. Prior solutions have included placing such machinery in upper levels of such structures, or encasing such machinery in water-tight enclosures. There are, however, significant drawbacks and disadvantages to these solutions. For example, placing such machinery in upper levels of structures is very expensive and may not be feasible for existing structures to be retrofitted in this manner. Alternatively, encasing the machinery in water-tight enclosures makes access to the machinery for maintenance and repair very difficult, and water-tight enclosures are buoyant when submerged, and buoyancy forces can adversely affect the structural integrity of the machinery.

Accordingly, there is a need for fuel oil pumps that can operate in flooded conditions without having to be located in the upper levels of a building or contained in a water-tight enclosure.

SUMMARY OF THE INVENTION

The present invention is directed to fully submersible fuel oil pump machinery that avoids the above-described shortcomings, and is designed to provide an uninterrupted fuel oil supply to critical equipment such as generators, boilers and the like, in residential buildings and in facilities that provide essential services, such as hospitals, communication/data centers, law enforcement, and financial institutions, during times of severe flooding. It is designed for installations below grade level, or in areas predisposed to environmental, historical, or manmade flooding, and is designed as a "true" submersible unit, utilizing Best-in-Class, ABB-Baldor continuous-in-air duty submersible motors, allowing the unit to continuously operate in either normal/dry conditions or submerged up to 160 feet under water. Its heavy weight, non-buoyant and open design allows the operator full access to all unit's components to perform visual inspections, maintenance, and repairs. It has a heavy-duty construction built with robust components and two coats of CORO-THANE® I Black Coal Tar are applied, to all steel and iron components, for lasting protection against rust and corrosion.

The present invention can cover a wide operating range from 114 GPH to 2,500 GPH at 150 PSI discharge pressure, and can be customized to meet a customer's specific requirements of design ratings, special materials, and/or accessories.

In accordance with a first aspect of the present invention, a submersible fuel oil apparatus includes a base; at least one platform supported above the base and having a top surface, an underside surface and an aperture therethrough; a submersible motor supported by one of the top surface and the underside surface of the platform and having a vertically oriented motor shaft; a fuel oil pump supported by the platform on a side of the platform opposite the motor and having a vertically oriented pump shaft, a pump inlet into which fuel oil is adapted to be delivered, and a pump outlet from which fuel oil is adapted to be pumped, the pump and motor positioned such that the motor shaft and the pump shaft are aligned, one of the motor shaft and pump shaft extending through the aperture in the platform; a coupler connecting the motor shaft and pump shaft to each other; inlet piping connected to the pump inlet; and outlet piping connected to the pump outlet.

Preferably, the submersible fuel oil apparatus further includes support brackets securely connecting the outlet piping to the base, and a mounting bracket having an upper connection surface, a lower connection surface, and an interior space, wherein the upper connection surface of the mounting bracket is connected to the underside surface of the platform, wherein one of the pump and motor is positioned underneath and connected to the lower connection surface of the mounting bracket, and wherein the coupler is positioned within the interior space of the mounting bracket. Preferably, the mounting bracket is generally u-shaped, and at least one coupling guard is removably mounted on the mounting bracket to isolate the coupler. The platform is preferably supported above the base by a plurality of legs attached to the base.

In accordance with another aspect of the invention, submersible fuel oil apparatus includes a base; at least one platform supported above the base and having a top surface, an underside surface and an aperture therethrough; a submersible motor mounted on the top surface of the platform and having a motor shaft extending vertically downward through the aperture in the platform; a fuel oil pump supported underneath the platform and having a pump shaft extending vertically upward, a pump inlet into which fuel oil is adapted to be delivered, and a pump outlet from which fuel oil is adapted to be pumped, the pump positioned such that the motor shaft and the pump shaft are aligned; a coupler connecting the motor shaft and pump shaft to each other; inlet piping connected to the pump inlet; and outlet piping connected to the pump outlet. Preferably, the apparatus includes support brackets securely connecting the outlet piping to the base, the fuel oil pump is supported from the platform by a mounting bracket having an upper connection surface, a lower connection surface, and an interior space, wherein the upper connection surface of the mounting bracket is connected to the underside surface of the platform, wherein the pump is positioned underneath and connected to the lower connection surface of the mounting bracket, and wherein the coupler is positioned within the interior space of the mounting bracket. Preferably. the mounting bracket is generally u-shaped, and further includes at least one coupling guard removably mounted on the mounting bracket to isolate the coupler. The platform preferably is supported above the base by a plurality of legs attached to the base.

In accordance with yet another aspect of the invention, a submersible fuel oil apparatus includes a base; a pair of platforms supported above the base, each of the platforms and having a top surface, an underside surface and an aperture therethrough; a pair of submersible motors, each of the motors being mounted on an upper surface of a respective one of the platforms and having a motor shaft extending vertically downward through the aperture in the respective platform; a pair of fuel oil pumps each supported underneath a respective one of the platforms and each having a pump shaft extending vertically upward, a pump inlet into which fuel oil is adapted to be delivered, and a pump outlet from which fuel oil is adapted to be pumped, each of the pumps positioned such that respective ones of the motor shafts and the pump shafts are aligned; a pair of couplers connecting respective ones of the motor shafts and pump shafts to each other; inlet piping connected to each of the pump inlets; outlet piping connected to each of the pump outlets; and support brackets securely connecting the outlet piping to the base. Preferably, the inlet piping includes a common inlet port adapted to deliver fuel oil to each of the pumps, and the outlet piping includes a common discharge port from which fuel oil is adapted to be pumped from the pair of pumps. Each of the fuel oil pumps is preferably supported from its respective platform by a mounting bracket having an upper connection surface, a lower connection surface, and an interior space, wherein the upper connection surface of the mounting bracket is connected to the underside surface of its respective platform, wherein each of the pumps is positioned underneath and connected to the lower connection surface of its respective mounting bracket, and wherein each of the couplers is positioned within the interior space of its respective mounting bracket. Each of the mounting brackets is generally u-shaped, and further include at least one coupling guard removably mounted on each of the mounting brackets to isolate the coupler. Each of the platforms is preferably supported above the base by a plurality of legs, the plurality of legs attached to the base.

BRIEF DESCRIPTION OF THE DRAWINGS

These and other aspects, details and objects of the invention will be described with reference to the following drawing figures of which.

DETAILED DESCRIPTION OF THE INVENTION

Figure 1A:
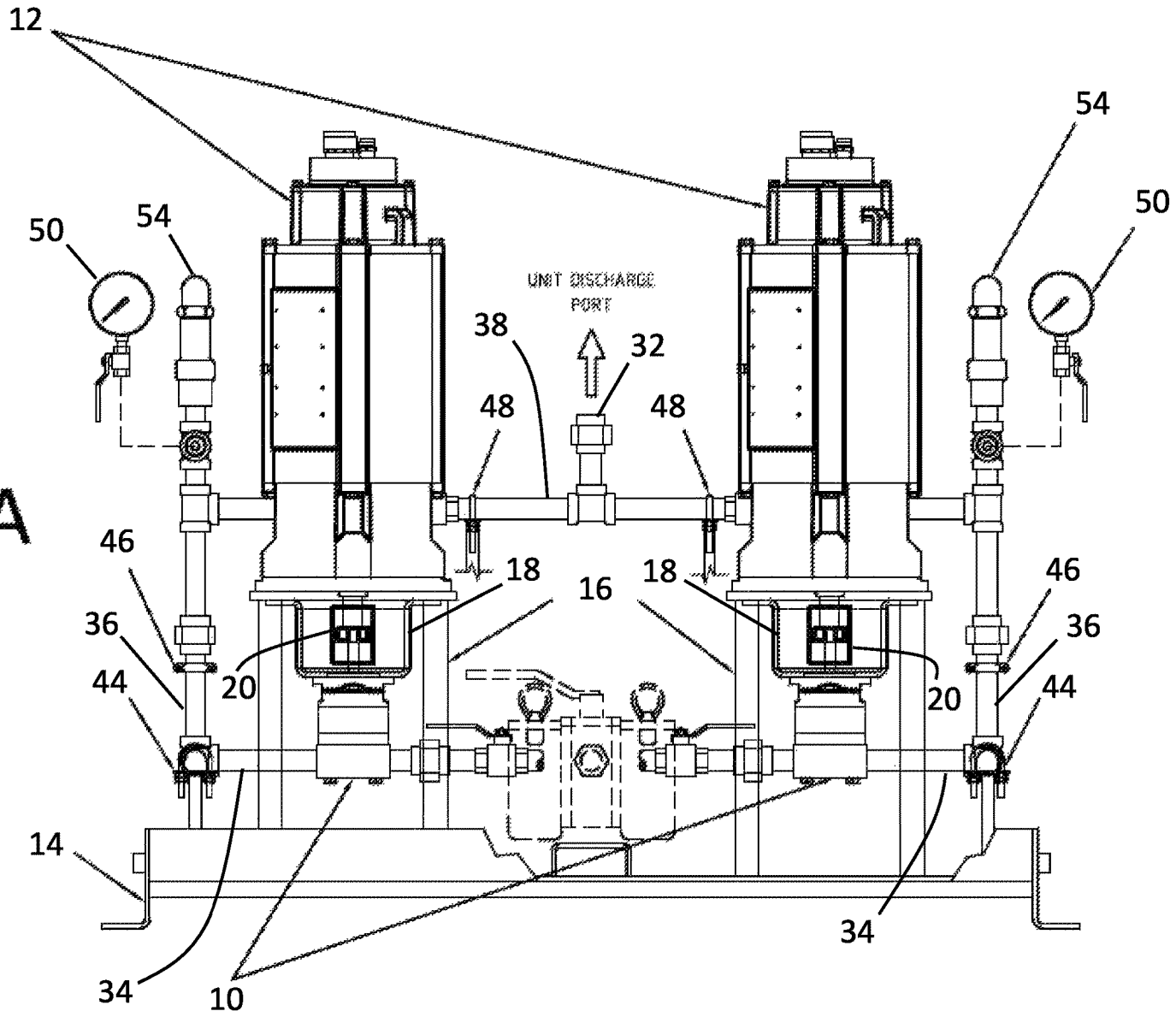
FIGS. 1A-1C are front, side and top views, respectively, of a duplex submersible fuel oil set in accordance with the present invention.
Figure 1C:
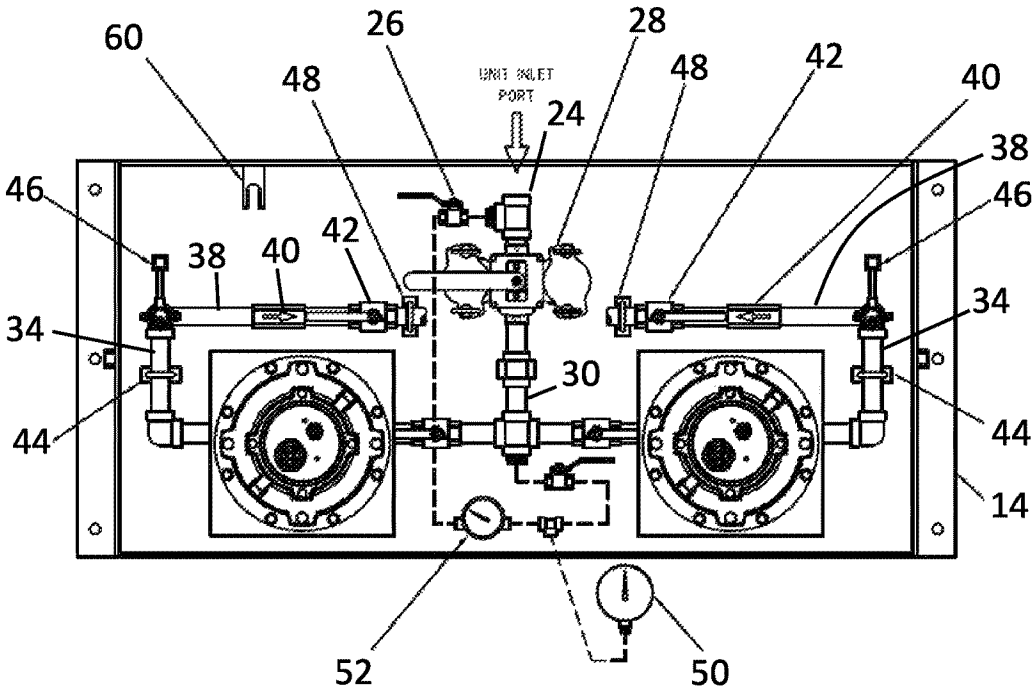
Figure 1B:
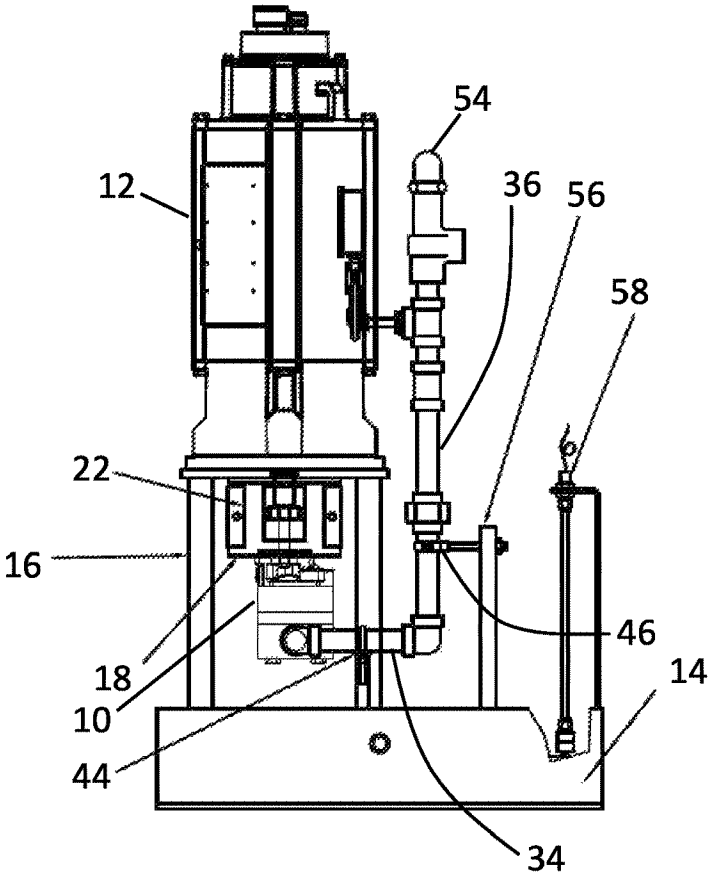
Figure 2:
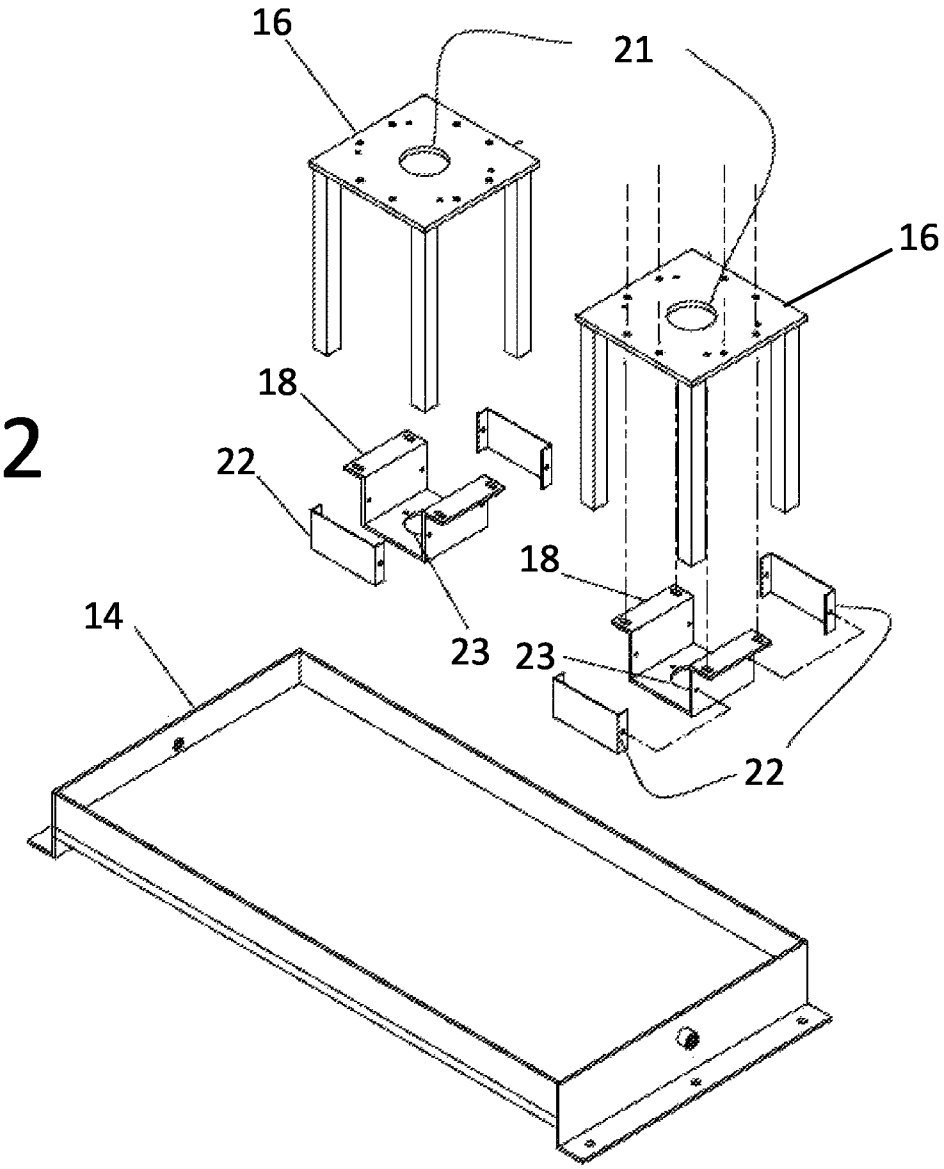
FIG. 2 is an exploded view of the motor pedestal, pump-to-pedestal mounting bracket, 2-piece coupling guard and main base for use with the present invention.

As best shown in FIGS. 1A-C, two pumps 10, which in accordance with a preferred embodiment, are VIKING SG SERIES™ spur gear pumps, with cast iron casings, heat-treated gears and shafts, plain heads, Viton mechanical seals and carbon graphite bushings. The pumps 10 are powered by respective motors 12, which, in accordance with a preferred embodiment, are ABB-Baldor continuous-in-air duty, totally enclosed, non-ventilated submersible motors, supplied as standard, with oil-filled inner and outer slurry seals, built-in seal leak sensors, and up to 100-ft long removable submersible power & seal leak sensor cables. The motors 12 and pumps 10 are supported on a main base 14 by respective motor pedestals 16, details of which are shown in FIG. 2. The main base 14 is preferably formed of heavy-duty fabricated carbon steel welded-construction main base, 5/16 inches thick, with 3-inch drip Lip, (2) ¾ inch FNPT drain connections, and six anchor bolt holes as shown. The motor pedestals 16 are preferably heavy-duty fabricated carbon steel welded-construction engineered to rigidly support each motor's weight and absorb its torsional loads for vibration-free operation. The pedestals 16 include provisions for mounting the pumps 10 and coupling them to their respective motors 12, while providing full access to unit's components for ease of inspection, maintenance, and repair. A stainless-steel arrow preferably is riveted on each pedestal, allowing easy verification of motor rotation. The pedestals are preferably full fillet welded to main base.

Each motor 12 is mounted on the top of its respective pedestal 16, as shown in FIGS. 1A and 1B. The pumps 10 are mounted on the undersides of their respective motor pedestals 16 by respective pump-to-pedestal mounting brackets 18, each of which is connected to the underside of the pedestals by stainless-steel fasteners, as shown in FIG. 2. Although mounting the motors on the top of the pedestal, and the pumps underneath the pedestal, is the preferred configuration, the configuration can be reversed, if desired, such that the pumps are on the top of the pedestal and the motors are underneath the pedestal.

Preferably, the pump mounting brackets 18 are generally u-shaped, defining an interior space, and comprised of heavy-duty fabricated carbon steel, engineered to support each pump rigidly and independently, while allowing for easy pump-motor alignment. Each of the pumps 10 is mounted to the underside of its respective pump-to-pedestal mounting bracket 18, with the pump shaft extending vertically upward through a central aperture 23, FIG. 2, in the pump-to-pedestal mounting brackets. The shafts of the motors 12, on the other hand, extend vertically downward through central apertures 21 in the motor pedestals 16. The pump and motor shafts are connected by couplers 20, in a well-known manner, within the interior spaces of the pump-to-pedestal mounting brackets 18, as shown in FIGS. 1A and 1B. The open sides of each of the pump-to-pedestal mounting brackets 18 are covered using 2-piece OSHA compliant aluminum coupling guards 22, as best shown in FIG. 2, to isolate the couplers 20. The guards 22 are removable to provide easy access for pump-motor alignment and corrosion resistance.

In addition to the mounting of the pumps and motors, as described above, the piping, fittings, inlet and discharge ports, moisture detectors, pressure gauges, strainer, relief valves, check valves, isolation ball valves, fasteners, basin leak switch assembly, flow switch assembly, local power disconnects, and control panel are supported on the main base by supporting brackets, as shown in the drawings. Fuel oil is supplied via inlet port 24, FIG. 1C, flowing through a duplex strainer 28. The fuel oil is delivered to each pump 10 via inlet manifold 30 to thereby pump the oil to the discharge port 32, FIG. 1A, via respective lower horizontal piping 34, vertical piping 36, and common discharge manifold 38, the latter of which includes check valve 40 and isolation ball valve 42, FIG. 1C.

A discharge piping support system, including six support brackets, is preferably provided and used in conjunction with the pedestals 16 to offset, counterbalance and counterweight torsional forces and pipe stresses, especially in the common discharge manifold 38. Specifically, and as shown in the drawings, brackets 44 are provided for securing respective lower horizontal piping 34, brackets 46 are provided for securing respective vertical piping 36, and brackets 48 are provided for securing respective arms of the common discharge manifold 38. The six brackets are preferably supported by 11-Gauge Carbon Steel square tubing (one example of which, 56, is shown in FIG. 1B) designed to independently support the discharge piping and common discharge manifold, eliminating any stresses on the pumps' ports or unit components, and to provide leak-free and vibration-free operation. The pipe supports are full fillet welded to main base, while allowing for removal and/or replacement of all unit pipe sections and/or components.

Additionally, the following system components are employed, in accordance with the preferred embodiments, although various changes and substitutions may be available as will be appreciated by those skilled in the art:

Moisture Detectors

AMETEK Series 8040MD NEMA 1 moisture detectors are preferably supplied as standard (one for each motor) and are available in optional NEMA 4 enclosures.

Couplings

Aluminum jaw couplings with Hytrel inserts are preferably supplied, providing corrosion resistance.

Piping & Fittings

Carbon steel schedule 80 seamless interconnecting threaded piping, with union breakpoints, forged steel threaded pipe fittings class 2000 #, and forged steel threaded unions class 3000 # with Viton O-rings, are preferably supplied as standard on all units.

Pressure Gauge

H. O. Trerice Series D80 discharge and compound suction pressure gauges 50, FIGS. 1A, and 1C, are preferably supplied as standard, with liquid-filled, stainless-steel case, bronze tube, brass socket and 4" dial. Each gauge is supplied with 316SS full port isolation ball valve 26 as standard.

Differential Pressure Gauge

Differential pressure gauge 52, FIG. 1C, is preferably provided with 316ss tubing and full port isolation ball valve 26 is supplied across the duplex strainer inlet and outlet, as standard, and is preferably Ashcroft type 1130 with 0-30 PSID range, stainless steel case, brass body, in-line in/out ports, Viton O-ring, glycerin filled, and 4" diameter dial.

Duplex Strainer

Duplex strainer 28, FIG. 1C, is preferably Eaton Ball type duplex basket strainer model 53BTX, with threaded inlet/outlet connections, cast iron body, stainless steel diverter ball and 1/32" perforated baskets, Teflon seat, Buna N seals, is supplied as standard. Optional construction materials such as, bronze, carbon steel and stainless steel, may be utilized, if desired.

External Pressure Relief Valves

Two Fulflo V-Series adjustable pressure relief valves 54, FIGS. 1A and 1B, are preferably supplied in cast iron, with threaded connections, Buna O-ring cap seal and 410SS Piston, as standard. Optional construction materials such as, brass, steel and stainless steel, may be utilized, if desired.

Check Valves

Two Check-All style U3, 1500 PSIG (non-shock) check valves 40, FIG. 1C, are preferably supplied as standard, with a carbon steel body, threaded connections, Viton seat, and 316SS spring with 0.125 PSI cracking pressure. Optional construction materials such as, brass, 316SS and alloy 20, may be utilized, if desired.

Isolation Ball Valves

Apollo series 76F-100-A 316SS full port, 1000 CWP ball valves 42 and 26, FIG. 1C, are preferably supplied as isolation valves for suction, discharge, suction and discharge gauges, and differential pressure gauge, as standard.

Fasteners

All fasteners are preferably supplied in 316SS material as standard.

Coating

Two Coats of COROTHANE® I black coal tar are preferably applied to unit's cast iron, steel & fabricated steel components, as standard. Coats are applied 24-hour apart to allow for proper curing. Motors, and stainless steel & aluminum components preferably are not coated.

Basin Leak Assembly

Gems series LS-1755, 316SS basin leak switch assembly, formed of switch 58, FIG. 1B and bracket 60, FIG. 1C, is preferably supplied as standard to detect any fuel leak that collects in the main base during normal/dry operating conditions. The assembly includes an LS-1755 switch with up to 100-ft long leads enclosed in 3/8" liquid tight flexible PVC conduit, 316SS tubing, and 316SS fittings.

Flow Switch Assembly

An IFM Efector model SI5006 (SR5906 for 1½" discharge pipe size or larger) flow switch assembly is preferably supplied as standard, for pumps' lead-lag alternating operation. This assembly will preferably include a stainless-steel flow switch, SS Adapter, 4-meter cable, 316ss isolation ball valve, and coated forged steel fittings.

This component is installed above flood level.

Local Disconnects

As generally required by local codes, a local power disconnect must be installed near the pumping unit, to allow for immediate shut-down for maintenance purpose or emergency.

Control Panel

NEMA 12 duplex control panel is preferably supplied as standard.

This component is installed above flood level.

Thus, by providing the structures and components as described, the present invention provides fully submersible operation without compromising structural integrity and allowing full access to the machinery for maintenance and repair.

While the foregoing is directed to preferred embodiments of the present invention, further changes, objects, aspects and embodiments of the present invention will be appreciated by those in the art, without departing from the scope of the invention, which will be defined by the following claims.

I claim:

1. A submersible fuel oil apparatus, comprising:

a base configured to be secured to a horizontal surface of a building having at least one boiler or generator;

at least one platform supported on said base by a plurality of legs and having (i) a top surface, (ii) an underside surface and (iii) an aperture therethrough, said plurality of legs being fixedly connected to said base at one end and directly connected to said platform at the other end;

a submersible motor supported by one of said top surface and said underside surface of said platform and having a vertically oriented motor shaft;

a fuel oil pump supported by said platform on a side of said platform opposite said motor by a mounting bracket having a first side and a second side, said first side of said mounting bracket directly connected to said platform, wherein said pump is directly connected to said second side of said mounting bracket, said pump having (i) a vertically oriented pump shaft, (ii) a pump inlet into which fuel oil is adapted to be delivered, and (iii) a pump outlet from which fuel oil is adapted to be pumped, said pump and motor positioned such that said motor shaft and said pump shaft are aligned, one of said motor shaft and pump shaft extending through said aperture in said platform;

a coupler connecting said motor shaft and pump shaft to each other;

a removeable coupling safety guard for isolating said coupler when said apparatus is in operation, and allowing access to said coupler, between said legs, when said coupling guard is removed;

inlet piping for receiving fuel oil and connected to said pump inlet, said inlet piping located above and vertically separated from said base;

outlet piping for supplying fuel oil to said boiler or generator and connected to said pump outlet; and a plurality of support brackets fixedly connected to said base on one end thereof and fixedly connected to said inlet and outlet piping at another end thereof, to thereby fixedly secure said inlet and outlet piping to said base.

2. The submersible fuel oil apparatus of claim 1 wherein said mounting bracket has an upper connection surface, a lower connection surface, and an interior space, wherein said upper connection surface of said mounting bracket is connected to said underside surface of said platform, wherein one of said pump and motor is positioned underneath and connected to said lower connection surface of said mounting bracket, and wherein said coupler is positioned within said interior space of said mounting bracket.

3. The submersible fuel oil apparatus of claim 2 wherein said mounting bracket is generally u-shaped.

4. The submersible fuel oil apparatus of claim 1, wherein said plurality of legs are in direct contact with said base.

5. A submersible fuel oil apparatus, comprising:

a base configured to be secured to a horizontal surface of a building having at least one boiler or generator;

at least one platform supported on said base by a plurality of legs and having (i) a top surface, (ii) an underside surface and (iii) an aperture therethrough, said plurality of legs being fixedly connected to said base at one end and directly connected to said platform at the other end;

a submersible motor mounted on said top surface of said platform and having a motor shaft extending vertically downward through said aperture in said platform;

a fuel oil pump supported by said underside surface of said platform by a mounting bracket having a first side and a second side, said first side of said mounting bracket directly connected to said underside surface, wherein said pump is directly connected to said second side of said mounting bracket, said pump having (i) a pump shaft extending vertically upward, (ii) a pump inlet into which fuel oil is adapted to be delivered, and (iii) a pump outlet from which fuel oil is adapted to be pumped, said pump positioned such that said motor shaft and said pump shaft are aligned;

a coupler connecting said motor shaft and pump shaft to each other;

a removeable coupling safety guard for isolating said coupler when said apparatus is in operation, and allowing access to said coupler, between said legs, when said coupling guard is removed;

inlet piping for receiving fuel oil and connected to said pump inlet, said inlet piping located above and vertically separated from said base;

outlet piping for supplying fuel oil to said boiler or generator and connected to said pump outlet; and a plurality of support brackets fixedly connected to said base on one end thereof and fixedly connected to said inlet and outlet piping at another end thereof, to thereby fixedly secure said inlet and outlet piping to said base.

6. The submersible fuel oil apparatus of claim 5 wherein said mounting bracket has an upper connection surface, a lower connection surface, and an interior space, wherein said upper connection surface of said mounting bracket is connected to said underside surface of said platform, wherein said pump is positioned underneath and connected to said lower connection surface of said mounting bracket, and wherein said coupler is positioned within said interior space of said mounting bracket.

7. The submersible fuel oil apparatus of claim 6 wherein said mounting bracket is generally u-shaped.

8. The submersible fuel oil apparatus of claim 5, wherein said plurality of legs are in direct contact with said base.

9. A submersible fuel oil apparatus, comprising:

a base configured to be secured to a horizontal surface of a building having at least one boiler or generator;

at least one platform supported on said base by a plurality of legs and having (i) a top surface, (ii) an underside surface and (iii) an aperture therethrough, said plurality of legs being fixedly connected to said base at one end and directly connected to said platform at the other end;

a submersible motor mounted on said top surface of said platform and having a motor shaft extending vertically downward through said aperture in said platform;

a fuel oil pump supported by said underside surface of said platform by a mounting bracket having a first side and a second side, said first side of said mounting bracket directly connected to said underside surface, wherein said pump is directly connected to said second side of said mounting bracket, said pump having (i) a pump shaft extending vertically upward, (ii) a pump inlet into which fuel oil is adapted to be delivered, and (iii) a pump outlet from which fuel oil is adapted to be pumped, said pump positioned such that said motor shaft and said pump shaft are aligned;

a coupler connecting said motor shaft and pump shaft to each other;

inlet piping for receiving fuel oil and connected to said pump inlet, said inlet piping located above and vertically separated from said base;

outlet piping for supplying fuel oil to said boiler or generator and connected to said pump outlet; and support brackets securely connecting said outlet piping to said base.

10. The submersible fuel oil apparatus of claim 9, wherein said inlet piping comprises a common inlet port adapted to deliver fuel oil to each of said pumps, and said outlet piping comprises a common discharge port from which fuel oil is adapted to be pumped from said pair of pumps.

11. The submersible fuel oil apparatus of claim 10, wherein each of said mounting brackets has an upper connection surface, a lower connection surface, and an interior space, wherein said upper connection surface of said mounting bracket is connected to said underside surface of its respective platform, wherein each of said pumps is positioned underneath and connected to said lower connection surface of its respective mounting bracket, and wherein each of said couplers is positioned within said interior space of its respective mounting bracket.

12. The submersible fuel oil apparatus of claim 11 wherein each of said mounting brackets is generally u-shaped.

13. The submersible fuel oil apparatus of claim 9, wherein said plurality of legs are in direct contact with said base.

* * * * *